United States Patent [19]

Offlee, Sr.

[11] 4,207,994

[45] Jun. 17, 1980

[54] REFRIGERATOR SYSTEMS UTILIZING ASSEMBLIES TO ENABLE DISPENSING COLD WATER OR ICE MADE FROM PURIFIED WATER

[76] Inventor: James E. Offlee, Sr., 4506 Don Pablo Pl., Los Angeles, Calif. 90008

[21] Appl. No.: 8,956

[22] Filed: Feb. 2, 1979

[51] Int. Cl.[2] ..... B67D 5/62

[52] U.S. Cl. ..... 222/146 R; 165/63; 62/393; 222/63

[58] Field of Search ..... 62/340, 338, 391, 393; 417/40, 316; 222/63, 146 R; 165/61, 63

[56] References Cited

U.S. PATENT DOCUMENTS

| | | | |
|---|---|---|---|
| 1,868,837 | 7/1932 | Markus | 62/393 |
| 2,434,771 | 1/1948 | Mueller et al. | 417/316 X |
| 2,525,709 | 10/1950 | Morrison | 62/391 X |
| 2,725,725 | 12/1955 | Materese et al. | 62/391 X |
| 2,767,960 | 10/1956 | Fast | 165/61 X |
| 2,963,885 | 12/1960 | Loewenthal | 62/391 X |
| 3,528,587 | 9/1970 | Popinski | 222/63 X |
| 3,541,808 | 11/1970 | Materese | 62/393 X |
| 3,969,909 | 7/1976 | Barto et al. | 62/340 X |
| 3,983,583 | 10/1976 | Herman et al. | 62/340 X |
| 4,027,499 | 6/1977 | Barto et al. | 62/340 |
| 4,073,159 | 2/1978 | Trippi | 62/340 |

*Primary Examiner*—Albert J. Makay

*Assistant Examiner*—William E. Tapolcai

*Attorney, Agent, or Firm*—Romney, Schaap, Golant, Disner & Ashen

[57] ABSTRACT

The invention relates to assemblies for use with refrigerators and refrigerators utilizing such assemblies to enable dispensing of cold water or ice made from purified water. Refrigerators of this type are provided with a unit which dispenses the cold water or ice and which units usually include a water input, and may on some occasions, include a valve in the input line. This latter valve is designed to open and close when the unit requires makeup water. An assembly is used in conjunction with the refrigerator and which assembly generally comprises a support means in the form of a cabinet for retaining a flask of purified water in an inverted position and where the water from the flask is introduced into a holding chamber in the cabinet. The water is pumped from the holding chamber by means of a pump in the cabinet, to the unit in the refrigerator through the water input. Further, a switch is electrically connected to the pump and is operable in response to the opening and closing of the valve for causing energization and de-energization of the pump. In an alternate embodiment, a water purifier, as for example, a zeolite exchange resin unit may be provided in place of the flask of purified water as means to provide a source of purified water.

28 Claims, 7 Drawing Figures

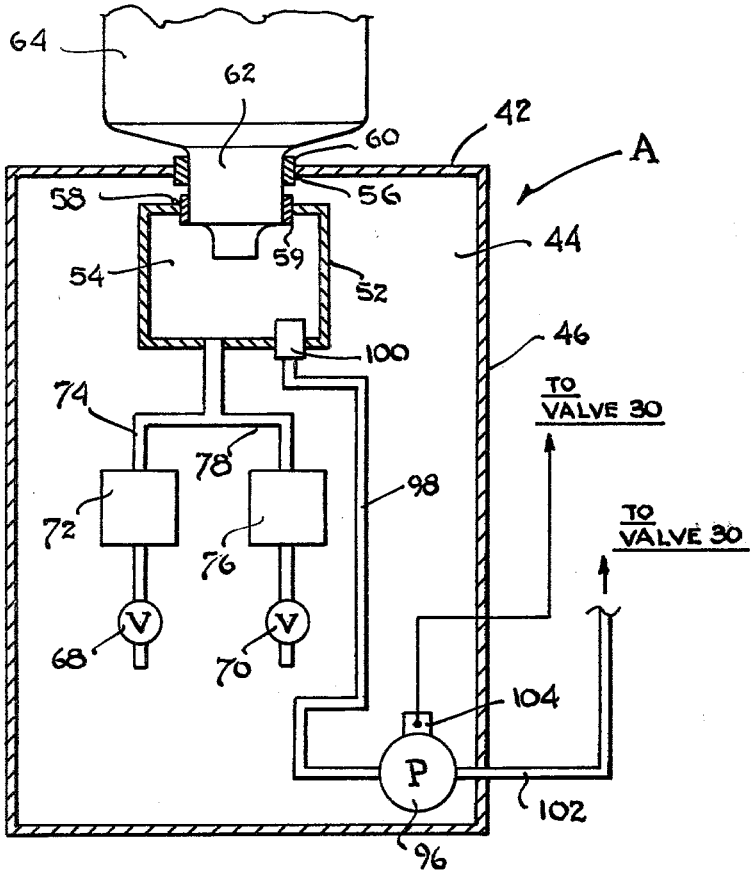
FIG. 3
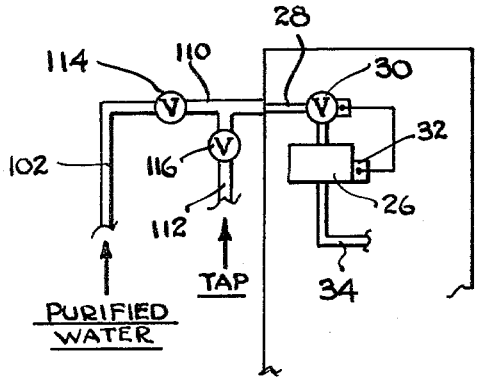
FIG. 4
FIG. 6
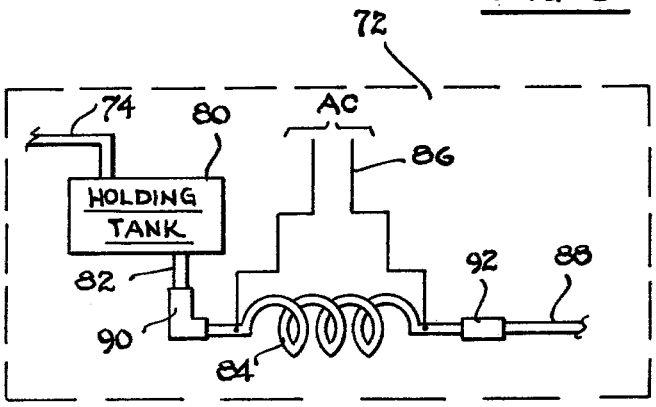

REFRIGERATOR SYSTEMS UTILIZING ASSEMBLIES TO ENABLE DISPENSING COLD WATER OR ICE MADE FROM PURIFIED WATER

BACKGROUND OF THE INVENTION

1. Field of the Invention

This invention relates in general to certain new and useful improvements in assemblies for use with refrigerators and refrigerator systems utilizing such assemblies to enable dispensing of cold water or ice made from purified water introduced into a unit in the refrigerator, and more particularly, to refrigerators of this type which operate in conjunction with assemblies capable of dispensing purified water provided for the intake to the unit in the refrigerator to thereby enable dispensing cold water or ice made from purified water.

2. Brief Description of the Prior Art

Refrigerators having units capable of dispensing cold water or ice have been commercially available. Typically, the refrigerators include units which are operatively connected to the freezer compartment and are designed to receive water from a conventional source, such as conventional tap water. This tap water is used, in turn, to make up the cold water for dispensing from a cold water outlet on the refrigerator, or otherwise, to make ice for dispensing if ice cubes, or chipped ice, from another dispenser on the refrigerator.

In addition, there have been several proposals to provide refrigerators having dispensers which are capable of dispensing liquids other than just tap water, as for example, orange juice, fresh fruit drinks, or the like. However, to date, there have been no refrigerator units which are capable of dispensing purified water on a highly effective and relatively low-cost basis and which is essentially fully automated in its operation.

OBJECTS OF THE INVENTION

It is, therefore, a primary object of the present invention to provide a refrigerator having a unit capable of dispensing cold water or ice and which is connected to a source of purified water for preparation of the cold water or ice for dispensing from the refrigerator.

It is another object of the present invention to provide an apparatus which is provided as an assembly for connection to a refrigerator of the type stated, having a unit capable of dispensing cold water or ice, and which assembly is also capable of separately dispensing cold water or hot water, or both.

It is a further object of the present invention to provide a system involving an assembly in the form of a cold water dispenser which is capable of dispensing purified water and a refrigerator having a unit capable of dispensing cold water or ice and which are operated in conjunction with each other such that the cold water or ice dispensed from the refrigerator is made from purified water.

It is also an object of the present invention to provide an assembly of the type stated which pumps purified water from a chamber therein to the unit of the refrigerator in response to opening and closing of a valve associated with the unit of the refrigerator.

It is another salient object of the present invention to provide an assembly of the type stated which includes a switch means operatively connected to a pump for pumping water from a source to a unit on the refrigerator and which is also operatively connected to and operable by a valve associated with the inlet of the unit in the refrigerator.

It is an additional object of the present invention to provide an assembly of the type stated which can be constructed at a relatively low unit cost, and which is highly efficient in its operation.

With the above and other objects in view my invention resides in the novel features of form, construction, arrangement, and combination of parts presently pointed out and described in the claims.

BRIEF SUMMARY OF THE DISCLOSURE

This invention relates in general to certain new or useful improvements in refrigerators which are capable of dispensing ice and/or cold water and specifically, refrigerators of those types capable of dispensing cold water or ice, or both prepared from purified water.

In one embodiment of the invention, the apparatus comprises an assembly which is used with the refrigerator. This assembly may adopt the form of a cold water dispensing unit of the type which dispenses cooled purified water. This assembly may be in the form of a cabinet which includes an internal holding chamber therein to receive the purified water. A flask containing purified water is disposed on the upper end of the cabinet in an inverted position so that the neck of the flask extends into the cabinet. In this way, water may pass through the neck of the flask into the internal chamber located in the cabinet.

This cabinet is provided with a pump for pumping the purified cold water to the refrigerator. In this case, the purified water from the flask, preferably, although not necessarily, by-passes any chilling unit, or cooling unit located in the cabinet which cools the water for dispensing from the cabinet.

The refrigerator is typically provided with a unit capable of generating the ice and/or cold water from conventional tap water. In this case, the unit capable of generating the ice or cold water will include one or more outlets for providing cold water or ice, or both. In addition, the unit capable of dispensing the cold water and/or ice could also be provided with additional outlets for producing ice in various forms, as for example, chipped ice, cubed ice, or the like.

The unit which produces the cold water or ice may include a storage tank or reservoir for normally storing tap water which is to be used for producing the cold water or ice. In addition, this unit will include an inlet pipe which leads into this last-mentioned tank or reservoir and also extends outwardly of the refrigerator for connection to a source of water, as for example, conventional tap water. In some cases, the unit may be provided with a valve which is openable and closeable in order to provide makeup water to the storage tank or reservoir in the unit of the refrigerator.

The assembly of the present invention includes the pump, as aforesaid, which is connected to the inlet pipe, or so-called "input", on the refrigerator. Moreover, the pump is provided with a switch which is electrically connected to the pump in such manner that it causes energization and de-energization of the pump. Further, the switch is electrically connected to the valve, such that the switch is operated by the valve on the refrigerator. In this case, when the storage tank or reservoir in the refrigerator needs make-up water, the valve will open and also cause the switch to electrically close an electrical current, thereby causing the pump to operate. In like manner, when the storage tank or reservoir has been filled with sufficient make-up water, then the switch which is operated by the valve will de-energize the pump.

The valve on the refrigerator is generally operated by means of a float operated sensor or similar water level sensor which is connected to the storage tank or reservoir in the refrigerator. Thus, when the tank or reservoir is low in the amount of storage water to be used in the production of ice or cold water, the float will generate a signal for operation of the valve or otherwise close a switch which, in turn, operates the valve by opening of the same. The opening of the valve, in turn, operates the switch on the pump, as aforesaid to energize the pump and thereby pump the purified water. In many cases, where the refrigerator is not provided with a valve, the assembly of the invention may be suitably provided with such a valve to be installed in the input line.

In another embodiment of the invention, it is not necessary to utilize a flask of purified water. The unit comprising the cabinet may be provided with a water purifier, as for example, a zeolite resin exchanger which, in turn, is capable of providing purified water. In this respect, any conventional unit capable of providing the purified water may be used in the cabinet.

As used herein, the term "purified water" is used in the sense that it is not conventional tap water, but has at least been treated such that it does not include many of the bacteriostats and like compositions normally added to water, such as chlorine, and the like. In this respect, mountain spring water even though not specifically chemically treated, is often classified as purified water. Further, water which has been specially treated by commercial water treating companies is often referred to as purified water. Consequently, in accordance with the present invention, the term "purified water" is used in the generic sense to include that water which may have been treated, but which is not necessarily deionized water, or water of the quality of deionized water or otherwise, water which may not have been treated but does not contain contaminants normally present in municipality-provided water.

In another embodiment of the invention, the inlet to the water cooling unit of the refrigerator may be provided with a T-fitting for connection to both a conventional water tap source and an auxillary system capable of providing purified water, as for example, water from a flask containing purified water. In this case, the T-fitting will be provided with one or more valves or stop cocks such that the user of the system could provide either tap water or purified water to the water cooling or chilling unit of the refrigerator.

This invention possesses many other advantages, and has other purposes which may be made more clearly apparent from a consideration of forms in which it may be embodied. These forms are shown in the drawings accompanying and forming part of the present specification. They will now be described in detail, for the purpose of illustrating the general principals of the invention; but it is to be understood that such detailed descriptions are not to be taken in a limiting sense.

BRIEF DESCRIPTION OF THE DRAWINGS

Figure 1:
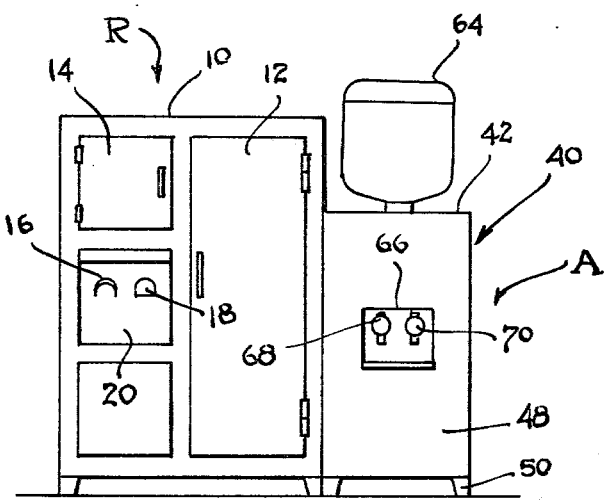
Figure 2:
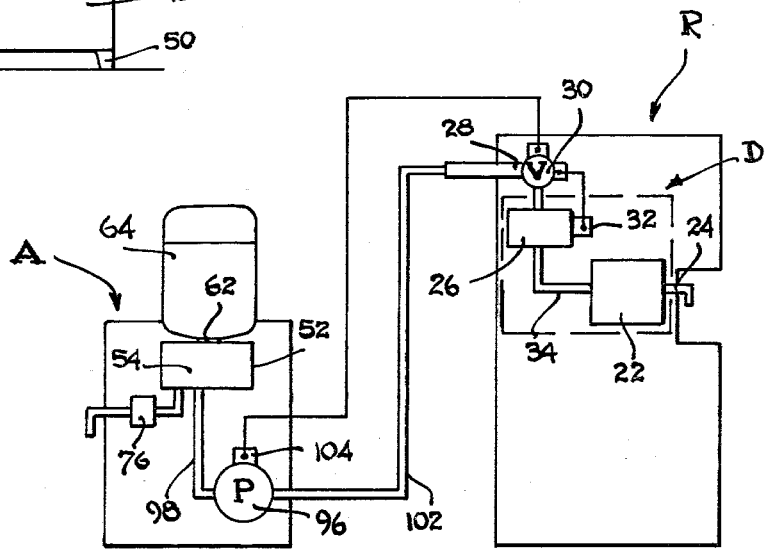
Figure 5:
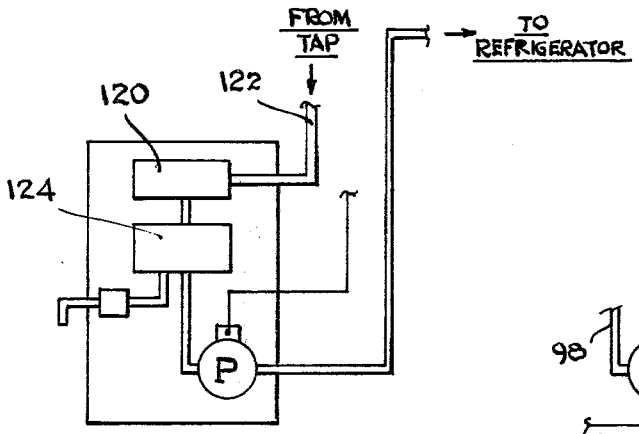
Figure 7:
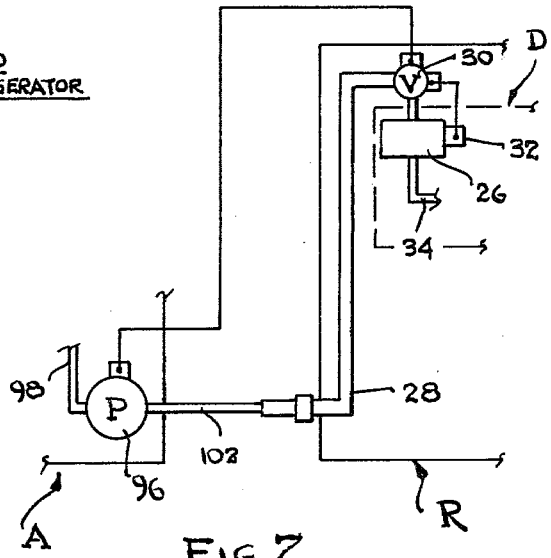

Having thus described the invention in general terms, reference will now be made to the accompanying drawings in which:

FIG. 1 is a front plan view of a refrigerator having water cooling and/or ice dispensing unit with an auxiliary mechanism connected thereto for providing a source of purified water;

FIG. 2 is a schematic side elevational view, somewhat similar to FIG. 1, and showing the internal components forming part of the refrigerator and the auxiliary purified water supply assembly;

FIG. 3 is an enlarged vertical sectional view showing a portion of the components of one embodiment of the purified water dispensing assembly used with the refrigerator of the present invention;

FIG. 4 is a fragmentary schematic view showing an alternate embodiment of the invention in which purified water and tap water may be provided;

FIG. 5 is a schematic side elevational view of another alternate embodiment of the present invention in which the assembly providing water includes a water purifier;

FIG. 6 is a fragmentary schematic view showing a mchanism for providing heated water which may be dispensed from the purified water dispensing unit; and FIG. 7 is a fragmentary schematic side elevational view somewhat similar to FIG. 2 and showing a slightly modified form of connecting an auxiliary mechanism to a refrigerator.

DETAILED DESCRIPTION OF PREFERRED EMBODIMENTS

Referring now in more detail and by reference characters to the drawings which illustrate practical embodiments of the invention, R designates a conventional refrigerator which is generally comprised of an outer housing 10 and having a door 12 hingedly mounted thereon for opening and leading to a refrigerator compartment. In addition, the refrigerator R may be conventionally provided with a second openable door 14 leading into a freezer compartment.

Refrigerators of the type used with the present invention will internally include a cooler unit normally comprised of a compressor, evaporator and condenser, connected in conventional fashion (all not shown) to cool the refrigerator compartment and freezer compartment. Refrigerators of this type will also include a water and/or ice dispensing unit D, which is more fully illustrated in FIG. 2 of the drawings. This water and/or ice dispensing unit D normally includes one or more outlet spigets, as for example, a cold water outlet spiget 16, and an ice outlet 18 formed within a recess area 20 of the refrigerator housing 10. In this case, only two such outlets are shown, although it should be understood that any number of outlets could be provided for enabling dispensing of various forms of ice, as for example, cubed ice, shaved ice, or the like.

The dispensing unit D in any conventional refrigerator, such as the refrigerator R, generally includes a cooling unit 22 which is again more fully illustrated in FIG. 2 and includes outlet pipes 24 leading to the outlets 16 and 18. This cooling unit 22 may form part of or be separate from the cooling unit which provides cooling for the refrigerator and freezer compartments of the refrigerator R. Further, the dispensing device D may also include a tank or reservoir 26 which serves as a storage tank for supplying water to the cooling unit 22. The tank 26 and the cooling unit 22 are generally conventional in their construction, and are therefore, neither illustrated or described in any further detail herein.

The tank 26 is also provided with a water inlet 28 in the form of an inlet pipe and which leads into the tank 26 for supplying a source of water thereto. In some refrigerators, the inlet 28 may be provided with a conventional valve 30 which is openable and closeable in order to permit make-up water to pass through the inlet pipe 28 and thereby provide make-up water to the tank 26.

The valve 30 may be operable by means of a float or liquid level sensor 32, which is operatively connected to the tank 26 and is also electrically connected to the valve 30 as in the manner as illustrated in FIG. 2 of the drawings. While the sensor 32 may not be electrically operable, it can, in turn, be connected to a switch (not shown) which can operate to open and close the valve 30. Further, the tank 26 is provided with an outlet line 34 which leads into the cooler 22, also in the manner as illustrated in FIG. 2 of the drawings.

The present invention also provides an auxilliary water dispensing apparatus A which is operated in conjunction with the refrigerator R, and which apparatus A is often referred to as an assembly. In this case, the conventional auxilliary water dispensing apparatus A generally comprises an outer housing 40 having a top wall 42, a back wall 44, side walls 46 and a front wall 48. Moreover, the water dispensing apparatus A, which is vertically disposed in the manner as illustrated in FIGS. 1 and 2, may be provided with conventional feet or pads 50 for support on the floor or other conventional supporting surfaces.

The water dispensing apparatus A is also provided with a tank or similar means 52 forming a water receiving chamber 54 located within the interior of the cabinet 40. Further, the top wall 42 is provided with an opening 56 which leads into and through a similar opening 58 formed in the tank 52 leading into the chamber 54. The opening 56 may be surrounded by a suitable grommet, such as a rubber or plastic grommet 60 for receiving the neck 62 of a conventional flask 64 containing purified water. In addition, the opening 58 could also be provided with a suitable grommet 59 to receive the neck of the flask. Again, the flask 64 which contains the purified water is usually provided from a commercially available source.

The auxilliary cabinet A is provided on the front wall 48 with a recess 66 having one or more spigots or outlets, as for example, the spigots 68 and 70, as illustrated in Margin 1 of the drawings. In the embodiment as illustrated, the spigot 68 is designed to provide hot water and the spigot 70 is designed to provide a source of cold water and which utilizes the water contained in the flask 64. Again, the spigots 68 and 70 are conventional in their construction and are, therefore, neither illustrated nor described in any further detail herein.

The spigot 68 is suitably connected to a heater mechanism 72 which, in turn, receives the purified water from the chamber 54 by means of an inlet pipe 74. In like manner, the auxilliary apparatus A is provided with a conventional cooling mechanism 76 which receives purified water from the chamber 54 and delivers the cooled water of the spigot 70 through an inlet pipe 78. The heater 72 leads into and provides hot water to the hot water dispensing spigot 68 and in the same manner.

One form of hot water heating mechanism which may be used in accordance with the auxilliary apparatus A of the present invention is more fully illustrated in FIG. 6. In this case, the heating unit 72 generally comprises a holding tank 80 which may receive water from the inlet pipe 74. Further, the holding tank 80 is provided with an outlet line 82 ultimately connected to a coil 84. In this case, the holding tank 80 may be formed of a suitable metal or plastic material, although the material of construction is not particularly critical. The outlet pipe 82 may be formed of either a metal, such as an electrically conductive metal, or an electrically non-conductive material.

The coil 84 is preferably formed of an electrically conductive material, such as copper, or the like, and which may have the suitable resistance characteristics in order to be receptive to an electrical current from a suitable source 86 and to be heated by the electrical current. Further, the coil 84 may be provided with a discharge line 88 connected to the spigot 68. In order to insulate the electrical current only to the coil section 84, insulating pipes 90 and 92 are interposed in the manner as illustrated in FIG. 6. In this way, it is possible to provide a source of hot water on a fairly quick and highly efficient basis by employment of the source of electrical current 86. In this case, the source of electrical current 86 may be the same source as used for operating the auxilliary apparatus A. Further, an additional holding tank, which may be insulated, could be provided on the discharge side of the discharge line 88 and effectively interposed prior to the spigot 68.

For the purposes of the present invention, the auxilliary apparatus A would be provided with a suitable electrically operable pump 96 and which has an inlet connected to the chamber 54 by means of an inlet line 98. The pump is suitably provided with an outlet pipe 102, the latter of which extends to and is connected to the input 28 leading into the refrigerator R. The pump is suitably provided with a switch 104, and which is again connected to the valve 30, in the manner as illustrated in FIG. 2 of the drawings. In this way, when the valve 30 is opened, the switch 104 is closed completing a current to the motor of the pump 96 thereby energizing the pump 96. In this way, water from the chamber 54 will be pumped to the input 28 and into the tank 32 forming part of the dispensing mechanism D of the refrigerator R. For this purpose, the valve 30 may be a conventionally operated solenoid valve of the type which is capable of being electrically connected to the switch 104. In this case, the solenoid valve would not be responsive to the switch 104, but rather, the switch 104 would be responsive to the valve 30. In other words, the opening and closing of the valve 30 will cause the actuation of the switch 104 which will, in turn, cause energization and de-energization of the pump 96.

In accordance with the above-identified construction, it can be observed that cold water can be dispensed from the auxilliary apparatus A which constitutes a water dispenser, or otherwise, from the refrigerator R. In this respect, it is to be noted that both the cold water from the auxilliary apparatus A, as well as from the refrigerator R would be based on purified water. The same holds true of the ice dispensed from the refrigerator R. In like manner, the auxilliary apparatus A which would constitute a dispenser, could be located in a remote position with respect to the refrigerator R, but nevertheless connected thereto as the manner illustrated in FIG. 2 of the drawings.

FIG. 4 illustrates a modified form of the invention in which a T-fitting 110 is employed in the inlet to the dispensing mechanism D forming part of the refrigerator R. In this case, the T-fitting would have one end connected to the inlet 28 as illustrated, with another end connected to the inlet tube 102 for receiving purified water. Further, the third terminal of the T-fitting would be provided with a pipe 112 for connection to a suitable source of tap water. Moreover, the inlets from the inlet line 102 and the inlet from the pipe 112 would be provided with stop cocks, or similar manually operated valves 114 and 116, respectively, such that one could select either purified water or tap water for use in the water dispensing mechanism D forming part of the refrigerator R.

FIG. 5 illustrates another embodiment of the present invention in which the auxilliary apparatus A utilizes a water purifier 120 as opposed to a water flask 64. In this case, the purifier 120 receives tap water from a conventional inlet tap line 122. Moreover, the purifier 120 is connected to a holding tank 124 in the manner as illustrated in FIG. 5. This holding tank 124 is similarly connected to the heating units 72 and/or the cooling units 76 and ultimately to the spigots 68 and 70, respectively. The purifier 120 may be any one of a number of conventionally known water purifiers, as for example, a purifier which contains a zeolite exchange resin.

FIG. 7 illustrates a slightly modified form of the invention in which the water inlet pipe 28 is located at the lower of the refrigerator R. In this case, the inlet pipe 28 is provided with a fitting 106 of conventional construction. Thus, the pump 96 is provided with a relatively short outlet line 102 which is connected directly to the fitting 106. The system illustrated in FIG. 7 of the drawings operates much in the same manner as the system previously described.

Thus, there has been illustrated and described a unique and novel assembly for use with a refrigerator having a unit to enable dispensing cold water or ice made from purified water, and which therefor fulfills all of the objects and advantages sought therefore. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by letters patent is:

1. An assembly for use with a refrigerator having a unit capable of dispensing cold water or ice and a water input operatively leading into said unit and a valve in said input, said assembly comprising:

(a) a support housing;

(b) container means to provide a source of purified water operatively supported by said support housing;

(c) a water chamber associated with said support housing to receive water from said container means;

(d) water transfer means disposed between the container means and the water chamber to allow the water to flow by gravity action from said container means into said chamber;

(e) a pump associated with said support housing and having an input connected to said chamber and an output connected to the water input on said refrigerator to supply purified water through said water input to said unit;

(f) switch means electrically connected to said pump and capable of causing energization and de-energization of said pump upon opening and closing of said switch means in response to opening and closing of said valve associated with the water input on said refrigerator and which valve is normally closed and opens only when said unit requires makeup water;

(g) a separate cooling means in said support housing and being connected to said water chamber to receive purified water therefrom; and (h) a spigot on said support housing and being manually operable to permit dispensing of cooled purified water delivered from said cooling means.

2. The assembly of claim 1 further characterized in that support housing comprises a vertically disposed cabinet and said water transfer means, said chamber, said switch means and said pump are located in said vertically disposed cabinet.

3. The assembly of claim 2 further characterized in that said cabinet has a top wall with an opening in said top wall communicating with said chamber, said container means is a flask being disposed in an inverted position on said top wall of the cabinet with a neck of the flask extending into the opening.

4. The assembly of claim 3 further characterized in that the pump is energized whenever the valve is opened and said switch is activated.

5. The assembly of claim 3 further characterized in that said container means is a flask of purifed water.

6. The assembly of claim 3 further characterized in that said container means is a water purifier having a portion to at least temporarily hold the water purified thereby.

7. The assembly of claim 4 further characterized in that said assembly comprises a valve which causes said switch to be activated upon closing and opening of said valve.

8. The assembly of claim 4 further characterized in that said chamber is formed in said cabinet and said flask is removably disposed in the opening in the top wall of said cabinet and said pump and said switch means are located within said cabinet.

9. The assembly of claim 8 further characterized in that said refrigerator comprises a water receiving tank connected to said water input, a liquid level sensor is associated with said tank and is operatively conected to said valve to open and close said valve in response to the level of water in said tank.

10. The assembly of claim 9 further characterized in that a water discharge spout is formed on said refrigerator dispensing purified water from said unit and through said spout in addition to dispensing of cooled purified water through the spigot on said support housing.

11. The assembly of claim 10 further characterized in that a cold water discharge spout extends from said cabinet, a cooler unit is located in said cabinet and is connected to said chamber for receiving purified water and cooling such water, said cold water discharge spout being connected to said cooler unit, a hot water discharge spout extends from said cabinet, a heater unit is located in said cabinet and is connected to said chamber for receiving purified water and heating such water, said hot water discharge spout being connected to said heater unit.

12. An assembly for use with a refrigerator having a unit capable of dispensing cold water or ice and a water receiving tank which leads into and provides water to said unit, said assembly comprising:

(a) a vertically disposed cabinet having an enclosing side wall and a top wall with an opening in said top wall, (b) a flask containing purified water operatively supported by said top wall in a generally inverted position and having a neck extending through said opening into said cabinet, (c) means forming a water chamber within said cabinet and located to receive water from said flask;

(d) water transfer means disposed between the flask and chamber to allow the water to flow by gravity action into said chamber;

(e) an electrically operable pump located within said cabinet and having an input side and an output side;

(f) a first tube connected to said input side of said pump and to the interior of the chamber;

(g) a second tube connected to said output side of said pump and also connected to a water input on said refrigerator to supply purified water thereto;

(h) a switch electrically connected to said pump and capable of causing energization and de-energization of said pump;

(i) a valve located in the water input on said refrigerator and which valve is normally closed and opens only when said unit requires makeup water, said switch means opening and closing in response to opening and closing of said valve, (j) float means operatively located in said water receiving tank to said refrigerator and being electrically connected to said valve to cause said valve to open and close in response to the level of water in said water receiving tank;

(k) a separate cooling means in said cabinet and being connected to such water chamber to receive purified water therefrom; and (l) a spigot on said cabinet and being manually operable to permit dispensing of cooled purified water delivered from said cooling means, independently of any dispensing of cold water or ice from said refrigerator.

13. The assembly of claim 12 further characterized in that a water discharge spout is formed in said cabinet for dispensing purified water from said chamber and through said spout.

14. The assembly of claim 13 further characterized in that a cold water discharge spout extends from said cabinet, a cooler unit is located in said cabinet and is connected to said chamber for receiving purified water and cooling such water, said cold water discharged spout being connected to said cooler unit, a hot water discharge spout extends from said cabinet, a heater unit is located in said cabinet and is connected to said chamber for receiving purified water and heating such water, said hot water discharge spout being connected to said heater unit.

15. A combination purified water dispenser and refrigerator system, said system comprising:

(a) a refrigerator having a refrigerator housing;

(b) a unit capable of generating cold water or ice in said refrigerator housing;

(c) a water input operatively leading into said unit and having an end extending outwardly of said housing;

(d) a valve in said input and which valve is normally closed and opens only when said unit requires makeup water;

(e) discharge means on said refrigerator housing and connected to said unit for dispensing cold water or ice;

(f) a purified water dispensing cabinet;

(g) a flask containing purified water operatively supported by said dispensing cabinet;

(h) means forming a water chamber located within said cabinet to receive water from said flask;

(i) water transfer means disposed between the flask and chamber to allow the water to flow by gravity action into said chamber;

(j) a pump located within said cabinet and having an input connected to the interior of the chamber and an output connected to the water input on said refrigerator to supply purified water thereto; and (k) switch means electrically connected to said pump and capable of causing energization and de-energization of said pump upon opening and closing of said switch means in response to opening and closing of said valve.

16. The system of claim 15 further characterized in that said cabinet has a top wall with an opening in said top wall communicating with said chamber, said flask being disposed open and inverted on said top wall of the cabinet with a neck of the flask extending into the opening.

17. The system of claim 3 further characterized in that the pump is energized whenever the valve is opening and said switch is activated.

18. The system of claim 16 further characterized in that a said refrigerator comprises a water receiving tank connected to said water input; a liquid level sensor is associated with said tank and is operatively connected to said valve to open and close said valve in response to the level of water in said tank.

19. The system of claim 18 further characterized in that a water discharge spout is formed in said cabinet for dispensing purified water from said chamber and through said spout.

20. The system of claim 18 further characterized in that a cold water discharge spout extends from said cabinet, a cooler unit is located in said cabinet and is connected to said chamber for receiving purified water and cooling such water, said cold water discharge spout being connected to said cooler unit, a hot water discharge spout extends from said cabinet, a heater unit is located in said cabinet and is connected to said chamber for receiving purified water and heating such water, said hot water discharge spout being connected to said heater unit.

21. An assembly for use with a refrigerator having a unit capable of dispensing cold water or ice and a water input operatively leading into said unit, a valve in said input, a water receiving tank connected to said water input, and a liquid level sensor associated with said tank and being operatively connected to said valve to open and close said valve in response to the level of water in said tank said assembly comprising:

(a) a support cabinet having a top wall and an opening in said top wall;

(b) a flask to provide a source of purified water operatively supported by said support cabinet in an inverted position with the neck of the flask extending into said opening;

(c) a water chamber associated in said support cabinet to receive water from said flask;

(d) water transfer means disposed between the flask and the water chamber to allow the water to flow by gravity action from said flask into said chamber;

(e) a pump associated with said support cabinet and having an input connected to said chamber and an output connected to the water input on said refrigerator to supply purified water through said water input to said unit;

(f) switch means electrically connected to said pump and capable of causing energization and de-energization of said pump upon opening and closing of said switch means in response to opening and closing of said valve associated with the water input on said refrigerator and which valve is normally closed and opens only when said unit requires makeup water, (g) a cooler unit located in said cabinet and being connected to said chamber for receiving, water from said chamber and cooling such water, (h) a cold water discharge spout on said cabinet and being connected to said cooler unit for dispensing the cold water, (i) a heater unit in said cabinet and being connected to said chamber for receiving the purified water and heating such water, and (j) a hot water discharge spout on said cabinet and being connected to said heating unit for dispensing the heated water.

22. An assembly for use with a refrigerator having a unit capable of dispensing cold water or ice and a water receiving tank which leads into and provides water to said unit, said assembly comprising:

(a) a vertically disposed cabinet having an enclosing side wall and a top wall with an opening in said top wall, (b) a flask containing purified water operatively supported by said top wall in a generally inverted position and having a neck extending through said opening into said cabinet, (c) means forming a water chamber within said cabinet and located to receive water from said flask;

(d) water transfer means disposed between the flask and chamber to allow the water to flow by gravity action into said chamber;

(e) an electrically operable pump located within said cabinet and having an input side and an output side;

(f) a first tube connected to said input side of said pump and to the interior of the chamber;

(g) a second tube connected to said output side of said pump and also connected to a water input on said refrigerator to supply purified water thereto;

(h) a switch electrically connected to said pump and capable of causing energization and de-energization of said pump;

(i) a valve located in the water input on said refrigerator and which valve is normally closed and opens only when said unit requires makeup water, said switch means opening and closing in response to opening and closing of said valve, (j) float means operatively located in said water receiving tank to said refrigerator and being electrically connected to said valve to cause said valve to open and close in response to the level of water in said water receiving tank;

(k) a cooler unit located in said cabinet and being connected to said chamber for receiving water from said chamber and cooling such water;

(l) a cold water discharge spout on said cabinet and being connected to said cooler unit for dispensing the cooled water;

(m) a heater unit in said cabinet and being connected to said chamber for receiving the purified water and heating such water; and (n) a hot water discharge spout on said cabinet and being connected to said heating unit for dispensing the heated water.

23. An assembly for use with a refrigerator having a refrigerator housing, a unit capable of generating cold water or ice in said housing and water input operatively leading into said unit and having an end extending outwardly of said housing, a valve in said input which is normally closed and opens when said unit requires makeup water, discharge means on said refrigerator housing and connected to said unit for dispensing cold water or ice; said assembly comprising:

(a) a support housing;

(b) container means to provide a source of purified water operatively supported by said support housing;

(c) a water chamber associated with said support housing to receive water from said container means;

(d) water transfer means disposed between the container means and the water chamber to allow the water to flow by gravity action from said container means into said chamber;

(e) a pump associated with said support housing and having an input connected to said chamber and an output connected to the water input on said refrigerator to supply purified water through said water input to said unit; and (f) switch means electrically connected to said pump and capable of causing energization and de-energization of said pump upon opening and closing of said switch means in response to opening and closing of said valve associated with the water input on said refrigerator and which valve is normally closed and opens only when said unit requires makeup water.

24. The assembly of claim 23 further characterized in that said assembly comprises:

(a) a separate cooling means in said support means and being connected to said water chamber to receive purified water therefrom, and (b) a spigot on said support housing and being manually operable to permit dispensing of cooled purified water delivered from said cooling means.

25. The assembly of claim 23 further characterized in that support housing comprises a vertically disposed cabinet and said water transfer means, said chamber, said switch means and said pump are located in said vertically disposed cabinet.

26. The assembly of claim 25 further characterized in that said cabinet has a top wall with an opening in said top wall communicating with said chamber, said container means is a flask being disposed in an inverted position on said top wall of the cabinet with a neck of the flask extending into the opening.

27. The assembly of claim 26 further characterized in that the pump is energized whenever the valve is opened and said switch is activated.

28. The assembly of claim 27 further characterized in that a cold water discharge spout extends from said cabinet, a cooler unit is located in said cabinet and is connected to said chamber for receiving purified water and cooling such water, said cold water discharge spout being connected to said cooler unit, a hot water discharge spout extends from said cabinet, a heater unit is located in said cabinet and is connected to said chamber for receiving purified water and heating such water, said hot water discharge spout being connected to said heater unit.

* * * * *